United States Patent [19]

Suzuki et al.

[11] 4,109,458

[45] Aug. 29, 1978

[54] DATE AND DAY CORRECTING DEVICE OF A TIMEPIECE

[75] Inventors: Keiichi Suzuki; Keikichi Takahashi; Eiichi Matsuura; Akinobu Harada, all of Tokyo, Japan

[73] Assignee: Kabushiki Kaisha Daini Seikosha, Japan

[21] Appl. No.: 744,926

[22] Filed: Nov. 24, 1976

[30] Foreign Application Priority Data

Nov. 27, 1975 [JP] Japan ..... 50-160640[U]

[51] Int. Cl.[2] ..... G04B 27/02

[52] U.S. Cl. ..... 58/63; 58/85.5; 58/58

[58] Field of Search ..... 58/4 R, 58, 88 B, 90 B, 58/63, 85.5

[56] References Cited

U.S. PATENT DOCUMENTS

| | | | |
|---|---|---|---|
| 3,714,774 | 2/1973 | Zaugg | 58/58 |
| 3,732,687 | 5/1973 | Miyasaka | 58/58 |
| 3,775,966 | 12/1973 | Matsuura | 58/58 |
| 3,779,000 | 12/1973 | Schmid | 58/58 |
| 4,027,468 | 6/1977 | Felty | 58/4 R |
| 4,028,881 | 6/1977 | Nakagawa | 58/58 |

*Primary Examiner*—Robert K. Schaefer
*Assistant Examiner*—Leonard W. Pojunas, Jr.
*Attorney, Agent, or Firm*—Robert E. Burns; Emmanuel J. Lobato; Bruce L. Adams

[57] ABSTRACT

A day and date correcting device in a timepiece having a day-star wheel and an annular date ring mounted concentrically of the day-star wheel. A correcting lever is positioned between the day-star wheel and the date ring, and the correcting lever has a first protrusion for engaging the day-star wheel to advance the same, and a second protrusion opposite the date ring for engaging the date ring to advance the same. A tab extends from the correcting lever. A correcting wheel having a peripheral tooth is mounted for rotation adjacent the tab and is positioned to engage the tab upon rotation of the correcting wheel to slide the correcting lever to a day correcting position and a date correcting position according to the direction of rotation of the correcting wheel for effecting day and date correction. The correcting wheel is manually rotatable. A resilient element restores the correcting lever to a neutral position intermediate the day correcting and the date correcting positions, after the correcting wheel has been rotated to advance the correcting lever to one of these positions and rotated further to disengage and clear the tab.

7 Claims, 4 Drawing Figures

DATE AND DAY CORRECTING DEVICE OF A TIMEPIECE

BACKGROUND OF THE INVENTION

This invention relates to a date and day correcting device and more particularly to a date and day correcting device which corrects date and day by sliding a correcting lever guided by at least two pins on a base plate of a timepiece.

Conventionally, a correcting device of this type corrects date and day by intermeshing a date and day correcting wheel, which oscillates mounted on a oscillating lever with a date and day wheel, by operation of a stem. In this type, however, a wide space in a thickness dimension of a timepiece is required and it is very difficult to make the timepiece thin. Moreover, a number of pins in the device is large and construction is complicated, operating characteristics are not good, price is high and reliability is not satisfactory.

SUMMARY OF THE INVENTION

This invention aims to eliminate the above mentioned difficulties and insufficiencies.

DESCRIPTION OF THE PREFERRED EMBODIMENTS

Figure 1:
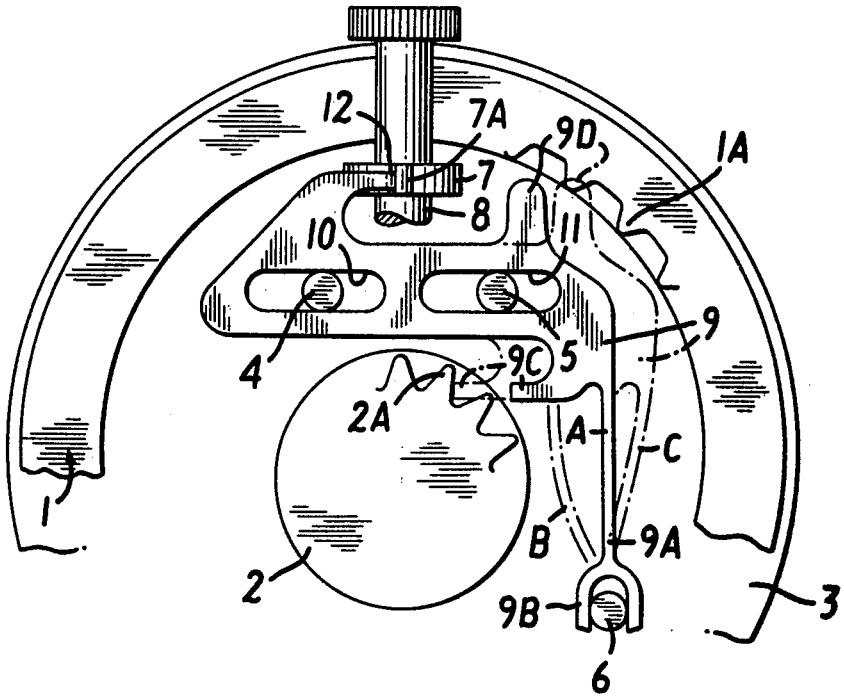
FIGS. 1 and 2 are a plan view and a sectional view showing the essential elements of the date and day correcting device according to the present inveniton.

In FIG. 1, numeral 1 is a date wheel, 2 is a day star with dial disk and both wheels 1, 2 are rotatably supported by a base plate 3.

Numerals 4, 5, 6 are pins respectively set in the base plate or the like, and 7 is a correcting wheel which rotates coincidently with a stem 8 as necessary. Numeral 9 is a date and day correcting lever which slides in a horizontal direction guided by elongated or elliptic holes 10, 11 which coincide with the above mentioned pins 4, 5. The date and day correcting lever 9 comprises a protruding portion or tab 12 (refer to FIG. 2) so that the lever 9 catches a tooth 7A of the correcting wheel 7 which intermeshes with the stem 8.

Further, the lever 9 is provided with a spring portion 9A so that the lever 9 is automatically restored to a neutral position A without contacting with the date wheel 1 and the day star with dial disk 2. And, the end point 9B of the spring portion 9A is dimensioned to engage with the pin 6 and remain fixed therewith.

Figure 2:
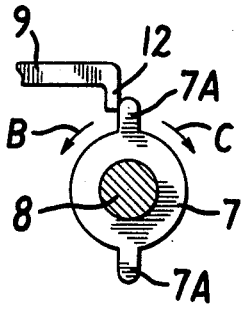

Accordingly, when the stem 8 is rotated in the direction of arrow B in FIG. 2, a protruding portion 12 of the date and day correcting lever 9 is displaced by the tooth 7A of the correcting wheel 7 which intermeshes with the stem 8.

And the lever 9 slides while being guided by the pins 4, 5 and the elliptic holes 10, 11, and the lever 9 moves to the position B in FIG. 1 against a restoring force developed due to the elasticity of the spring portion 9A. Then, a tooth surface 2A of the day star with dial disk 2 is displaced by an elongated portion 9c of the lever 9 and the day setting of the timepiece is corrected.

When this correction is finished, the intermeshing of the tooth 7A of the correcting wheel 7 and the protruding portion 12 of the lever 9 is released and the lever 9 is automatically restored to the neutral position A by restoring force of the elastic spring portion 9A.

On the other hand, when the stem 8 is rotated in the direction of arrow C in FIG. 2 in a counter direction to arrow B, the lever 9 slides to the C position in FIG. 1, and a lever elongated portion 9D pushes a tooth 1A of the date wheel 1, and then the date wheel 1 is displaced to correct the date setting of the timepiece, and then the lever 9 automatically is restored to the neutral portion A by operation of the elastic spring portion 9A as described the above.

Figure 3:
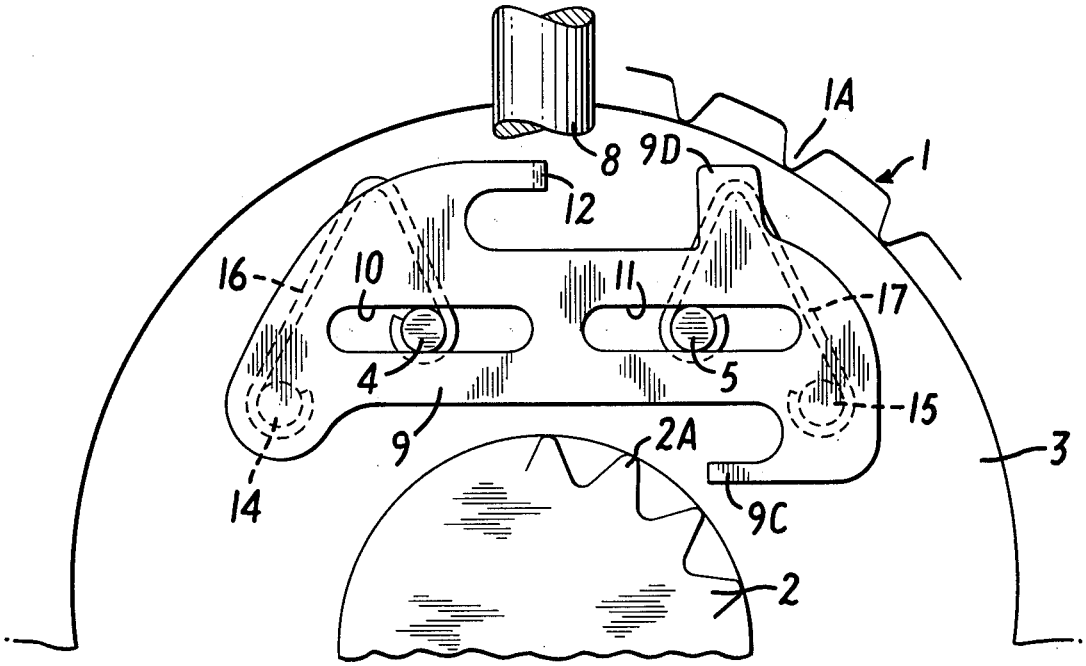
FIGS. 3 and 4 are diagrams showing other embodiments of the present invention.

As for the automatic restoring of the date and day correcting lever 9, other than by the above mentioned spring portion 9A, the lever 9 can be restored to the neutral position A by the spring members 16 and 17 provided between the pins 4, 5 and the pins 14, 15 on the lever 9 as shown in FIG. 3.

Figure 4:
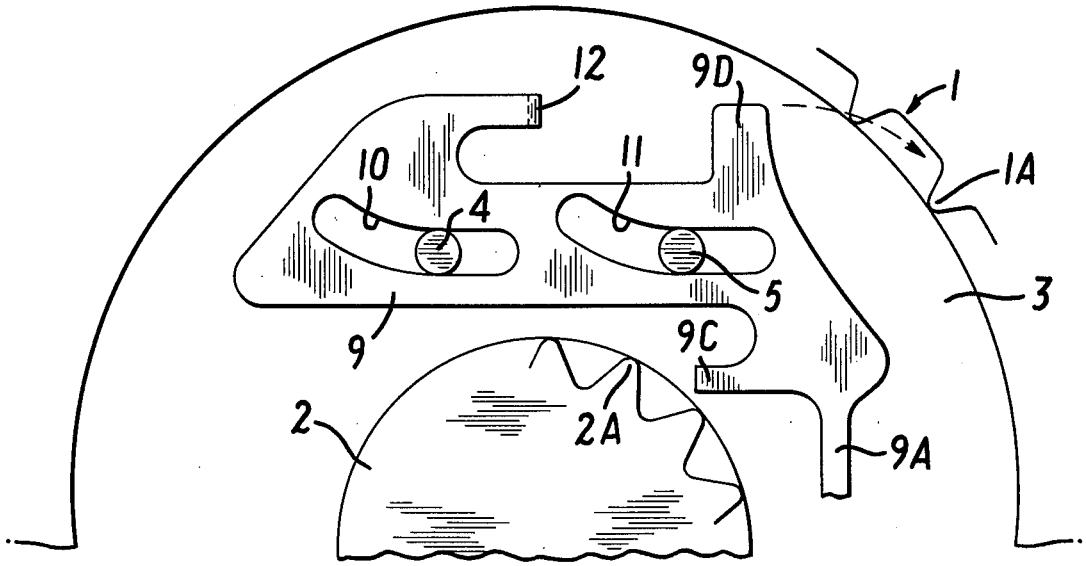

As for the sliding direction of the lever 9 other than displacement in straight line direction as in the above embodiment, if the elliptic or elongated holes 10 and 11 are shaped curvilinearly as shown in FIG. 4, the elongated portion 9D moves circularly when the date wheel 1 is corrected and date correction is more smoothly achieved.

As illustrated, according to the present invention, since date and day correction are accomplished by a respective portion of lever 9, the number of parts can be sharply cut in comparison with the conventional type device. Therefore excellent operating characteristics, low cost, high reliability and high quality timepiece can be provided a quantity. At the same time, a dimension in the timepiece thickness direction is reduced resulting in a thin timepiece since a space sufficient for the lever is enough. Therefore, the present invention contributes to make the timepiece thin and compact.

We claim:

1. In a timepiece: a base plate; a day-star wheel mounted for rotation on said base plate; an annular date ring mounted for rotation on said base plate concentrically of said day-star wheel to define an annular space between said day-star wheel and date ring, said date ring having inner teeth facing said day-star wheel; and a day/date correcting device for correcting setting of said day-star wheel and said date ring; wherein said correcting device is comprised of a correcting lever positioned within the space between said day-star wheel and said date ring, said correcting lever having a first protrusion opposite said day-star wheel for engaging said day-star wheel to advance the same when said correcting lever slides to a day correcting position, a second protrusion opposite said date ring for engaging said date ring to advance the same when said correcting lever slides to a date correcting position, and a tab extending therefrom, correcting lever mounting means for slidably mounting said correcting lever on said base plate for sliding between said day correcting position and said date correcting position and a neutral position intermediate said day and date correcting positions whereat neither said first protrusion and said second protrusion engage said day-star wheel and said date ring, respectively, a correcting wheel having a peripheral tooth and being mounted for rotation adjacent said tab of said correcting lever and position to engage said tab upon rotation of said correcting wheel to slide said correcting lever to said day correcting position and said date correcting position according to the direction of rotation of said correcting wheel for effectuating day and date correction, correcting wheel mounting means for mounting said correcting wheel for rotation adjacent said tab of said correcting lever, rotating means manually operable for rotating said correcting wheel to allow manual setting of day and date, and means for returning said correcting lever from said day and date correcting positions to said neutral position after said correcting wheel is rotated to disengage said tooth from said tab.

2. In a timepiece according to claim 1, wherein said correcting lever mounting means comprises: a pair of straight elongated slots through said correcting lever; and a pair of pins extending from said base plate and each extending into a respective one of said elongated slots, wherein said pins are dimensioned and positioned to allow said correcting lever to slide along a straight path the length of said slots; and said pins are oriented to position the path between said day and said date correcting positions.

3. In a timepiece according to claim 1, wherein said correcting lever mounting means comprises: a pair of arcuate elongated slots through said correcting lever; and a pair of pins extending from said base plate and each extending into a respective one of said elongated slots, wherein said pins are dimensioned and positioned to allow said correcting lever to slide along an arcuate path the length of said slots, and said pins are oriented to position the path between said day and said date correcting positions.

4. In a timepiece according to claim 1, wherein said means for returning comprises: an elongated resilient portion of said correcting lever extending outwardly therefrom and terminating at a U-shaped end portion remote from said correcting lever, and a pin extending from said base plate and engaged by said U-shaped end portion for maintaining said U-shaped end portion fixed, wherein said pin is positioned such that said elongated resilient portion is unflexed when said correcting lever is in the neutral position whereby displacement of said correcting lever from the neutral position is effective to flex said elongated resilient portion and thereby develop a restoring force for returning said correcting lever to the neutral position.

5. In a timepiece according to claim 1, wherein said means for returning comprises: at least one resilient spring-like member having a pair of ends; and means for fixing one of said ends to said base plate and for fixing the other of said ends to said correcting lever with said spring-like member in an unflexed condition when said correcting lever is in the neutral position whereby displacement of said correcting lever from the neutral position is effective to flex said spring-like member and thereby develop a restoring force for returning said correcting lever to the neutral position.

6. In a timepiece according to claim 1, wherein said rotating means manually operable for rotating said correcting wheel comprises: a stem concentric to said correcting wheel fixed thereto and extending therefrom.

7. In a timepiece according to claim 1, wherein said correcting wheel has a plurality of peripheral teeth sufficiently spaced to successively engage and clear the tab of said correcting lever for said correcting lever to return to the neutral position between each successive engagement of one of said teeth with said tab.

* * * * *